US007766619B2

(12) United States Patent
Fokine et al.

(10) Patent No.: US 7,766,619 B2
(45) Date of Patent: Aug. 3, 2010

(54) CONVECTIVELY COOLED GAS TURBINE BLADE

(75) Inventors: Arkadi Fokine, Moscow (RU); Alexander Trishkin, Lytkarino (RU); Vladimir Vassiliev, Turgi (CH); Dmitry Vinogradov, Moscow (RU)

(73) Assignee: Alstom Technology Ltd, Baden (CH)

( * ) Notice: Subject to any disclaimer, the term of this patent is extended or adjusted under 35 U.S.C. 154(b) by 188 days.

(21) Appl. No.: 11/907,420

(22) Filed: Oct. 12, 2007

(65) Prior Publication Data

US 2008/0181784 A1 Jul. 31, 2008

Related U.S. Application Data

(63) Continuation of application No. PCT/EP2006/061163, filed on Mar. 30, 2006.

(30) Foreign Application Priority Data

Apr. 14, 2005 (RU) ..... 2005110990

(51) Int. Cl.
*F01D 5/18* (2006.01)

(52) U.S. Cl. ..... 416/97 R

(58) Field of Classification Search ..... 416/97 R, 416/92; 415/115

See application file for complete search history.

(56) References Cited

U.S. PATENT DOCUMENTS

| | | | | |
|---|---|---|---|---|
| 2,963,269 | A * | 12/1960 | Gerdan et al. | 416/92 |
| 3,051,438 | A | 8/1962 | Roberts et al. | |
| 3,533,712 | A | 10/1970 | Kercher | |
| 3,628,880 | A | 12/1971 | Smuland et al. | |
| 3,807,892 | A | 4/1974 | Frei O et al. | |
| 3,885,886 | A | 5/1975 | Richter et al. | |
| 4,424,001 | A | 1/1984 | North et al. | |
| 4,529,357 | A | 7/1985 | Holland | |
| 4,738,587 | A * | 4/1988 | Kildea | 416/96 R |
| 5,002,460 | A * | 3/1991 | Lee et al. | 416/96 A |
| 5,993,156 | A | 11/1999 | Bailly et al. | |
| 6,224,328 | B1 | 5/2001 | Weigand et al. | |
| 6,382,914 | B1 * | 5/2002 | Tressler | 416/97 R |
| 6,485,255 | B1 | 11/2002 | Care et al. | |
| 2003/0156943 | A1 | 8/2003 | Strassberger et al. | |

FOREIGN PATENT DOCUMENTS

| | | |
|---|---|---|
| EP | 1 441 107 A2 | 7/2004 |
| GB | 656 634 A | 8/1951 |

OTHER PUBLICATIONS

PCT/ISA/210 & PCT/ISA/237 for PCT/EP2006/061163 dated Jul. 24, 2006.

* cited by examiner

*Primary Examiner*—Ninh H Nguyen
(74) *Attorney, Agent, or Firm*—Buchanan Ingersoll & Rooney PC

(57) ABSTRACT

A gas turbine has a cooling air passage which extends along the leading edge of the blade airfoil, which cooling air passage has an outlet opening which is arranged in the region of the blade tip. The contour of the outlet opening is geometrically similar to the cross section of the cooling air passage. As a result, flow inhomogeneities of the cooling air flow, which locally negatively influence heat transfer, and consequently cooling efficiency, are avoided.

16 Claims, 3 Drawing Sheets

CONVECTIVELY COOLED GAS TURBINE BLADE

RELATED APPLICATIONS

This application claims priority under 35 U.S.C. §119 to Russian Application 2005110990 filed in Russia on 14 Apr. 2005, and as a continuation application under 35 U.S.C. §120 to PCT/EP2006/061163 filed as an International Application on 30 Mar. 2006 designating the U.S., the entire contents of which are hereby incorporated by reference in their entireties.

TECHNICAL FIELD

A gas turbine blade is disclosed.

BACKGROUND INFORMATION

It is known, with cooled blades of gas turbines, to blow out cooling air at the blade tip, which for example promotes improved cooling of the seals which are arranged there. The cross sections of these outlet openings are generally dimensioned smaller than those of the cooling air passages. Therefore, they serve as restricting points and limit the mass flow of the cooling fluid which is blown out. The outlet openings customarily have circular or elliptical cross sections, and do not coincide with the cross-sectional shape of the cooling passage which guides the cooling air to the outlet opening. The abrupt cross-sectional change which consequently exists, results in unfavorable flow patterns which inter alia lead to increased pressure losses and locally increased material temperatures.

SUMMARY

An exemplary gas turbine blade of the type referred to in the introduction is disclosed so that the disadvantages of the prior art are avoided. More specifically, the gas turbine blade is to be disclosed in such a way that the heat transfer is evened out on the cooling side, and in this way uneven temperature distributions, with thermal stresses which shorten the service life, are avoided.

This, in addition to other advantageous effects, the gas turbine blade is able to achieve. In the blade, the contour of the outlet opening of the cooling air passage, which extends along the leading edge, is designed geometrically similar to the cross section of the cooling air passage. The result of this is that the cross-sectional transitions during the through-flowing of cooling air from the cooling air passage into the outlet opening are minimized. Eddy zones of the cooling air and deviations of the flow direction of the cooling air which is blown out, with their negative effects, are therefore avoided.

In one development of the blade, the cross-sectional area of the outlet opening is smaller than the cross-sectional area of the cooling air passage. As a result, the outlet opening can act as a restricting point and consequently serve for limiting the mass flow. That is to say, a rib is arranged in the region of the outlet opening. In one embodiment of the disclosure, the distance of the contour line of the outlet opening from the outer contour of the blade airfoil in the region of the leading edge of the blade airfoil, assumes values of between 138% and 162% of the local wall thickness of the wall of the blade airfoil. That is to say, the height of the rib in the region of the leading edge of the blade airfoil is 38% to 62% of the local wall thickness. In the region of the suction-side wall and/or the pressure-side wall of the blade airfoil, the distance of the contour line of the outlet opening from the outer contour of the blade airfoil assumes values of 113% to 138% of the local wall thickness of the wall of the blade airfoil. The height of the rib, therefore, in this region is 13% to 38% of the local wall thickness. In the region of the partition inside the blade, which for example separates the cooling air passage, which extends along the leading edge, from other cooling air passages, the height of the rib in one embodiment lies within the range of 0% to 225% of the wall thickness of the wall of the blade airfoil. These geometric specifications can naturally be applied independently of each other or in combination. The wall thickness of the wall of the blade airfoil in this case can vary in the flow direction of the blade airfoil; in one embodiment of the disclosure the wall thickness of the wall of the blade airfoil in the region of the outlet opening is constant.

The exemplary cooling air passage has an inlet opening which is arranged at the blade root. In this case, in one embodiment, fresh cooling air is supplied at the blade root and flows along the leading edge of the blade airfoil inside the blade airfoil to the blade tip, and flows out there through the outlet opening. In one development of the blades which are specified here, the blade is especially designed in a way in which it is purely convectively cooled in the region of the cooling passage. That is to say, there are no openings through which cooling air, for example as film cooling air, can reach the outer side of the blade airfoil. The entire cooling air mass flow which flows into the cooling air passage, therefore, flows out again through the outlet opening.

Blades of the previously described type are preferably used in gas turbines, as component parts of a rotor and/or of a stator.

BRIEF DESCRIPTION OF THE DRAWINGS

An exemplary embodiment is illustrated in the drawings. In detail, in the drawings.

All the figures are much simplified and only serve for better understanding of the disclosure; they are not to be considered as limitation of the disclosure.

DETAILED DESCRIPTION

Figure 1:
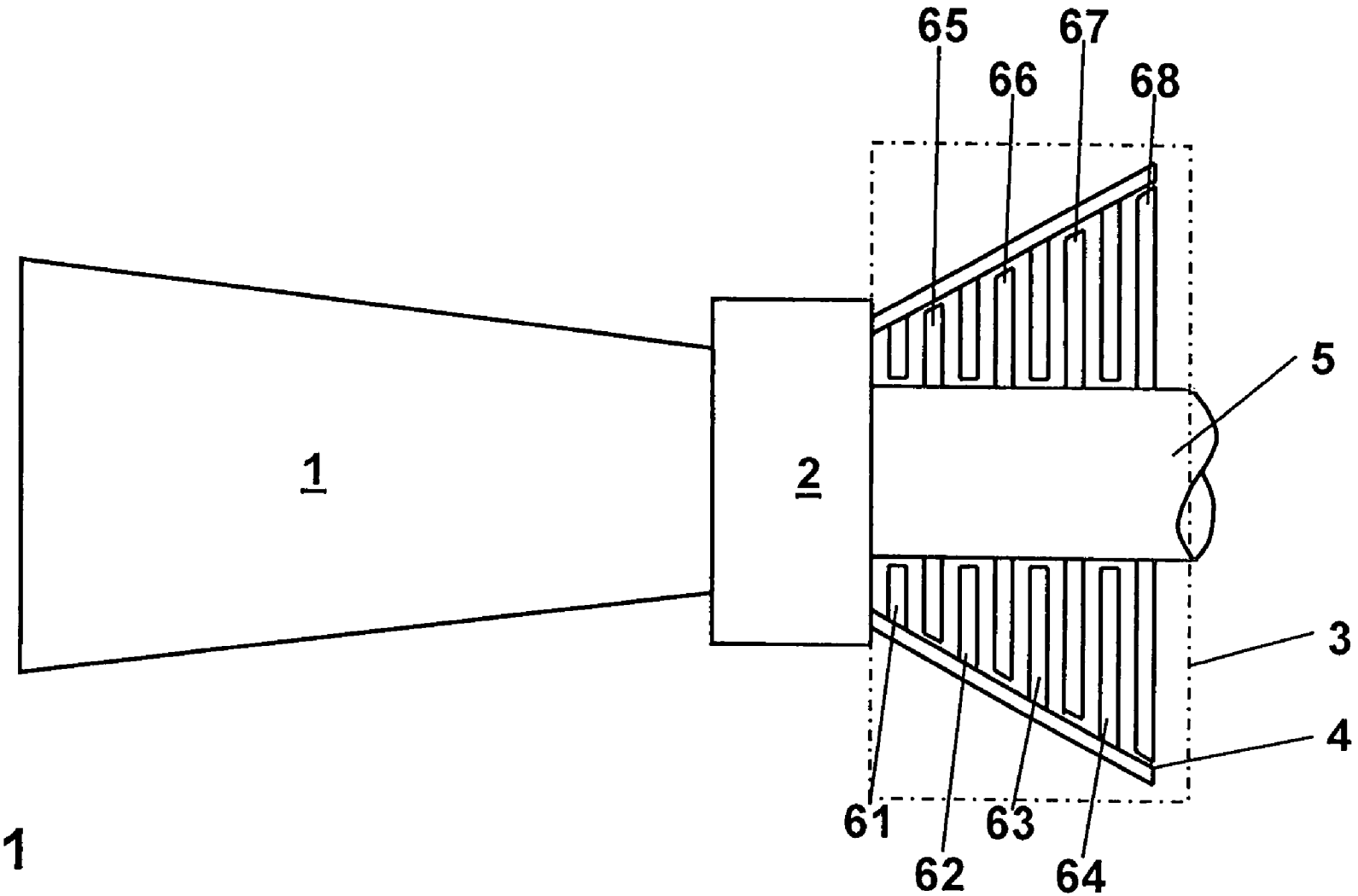
FIG. 1 shows a gas turbogroup.

In FIG. 1, a gas turbo group is exemplarily shown. This comprises in a manner known per se a compressor 1, a combustion chamber 2 and also the turbine 3. The turbine 3 is shown in section. A turbine stator comprises a casing 4 and also stationary blades 61, 62, 63 and 64. A turbine rotor comprises a shaft 5 and also rotating blades 65, 66, 67 and 68.

Figure 2A:
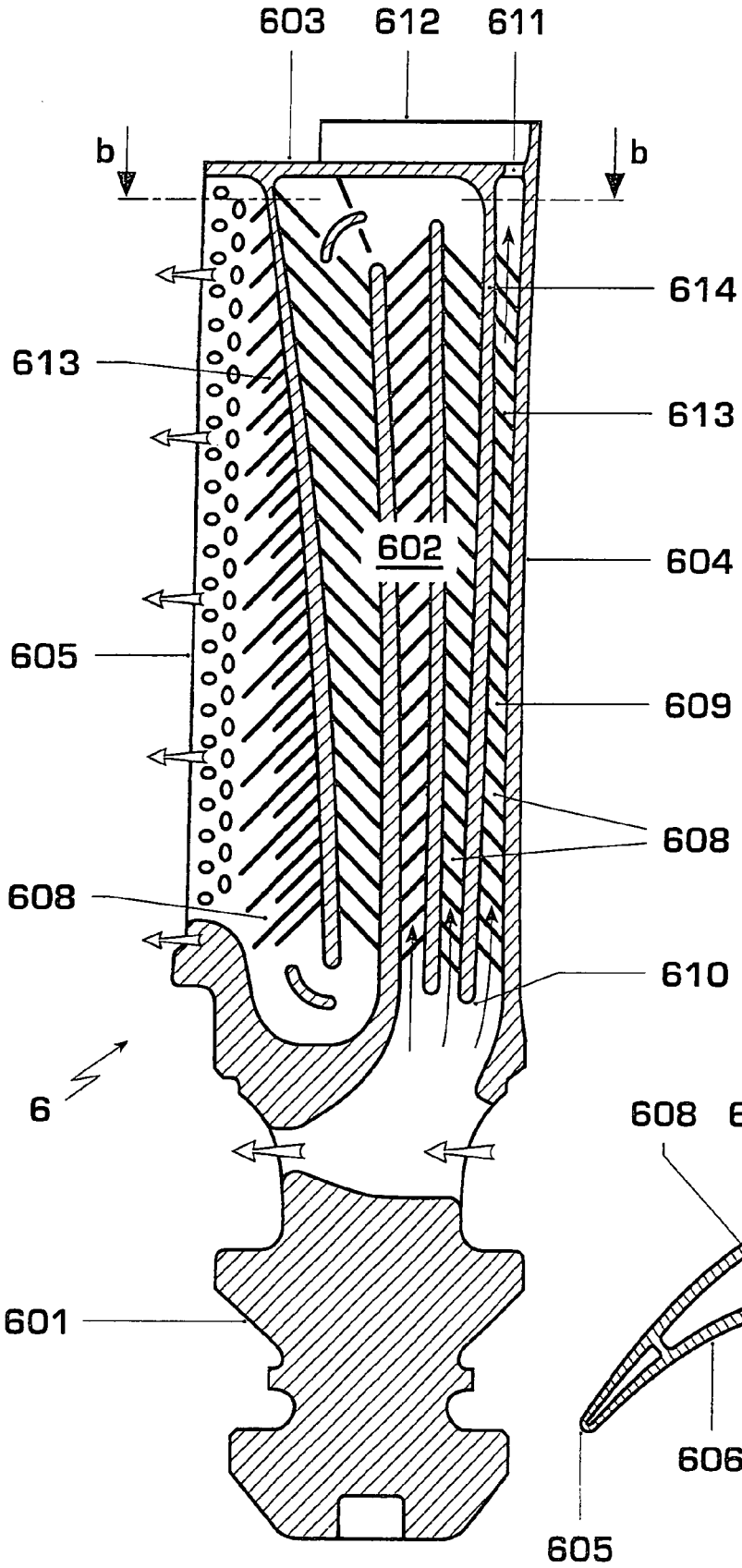
FIG. 2 shows a gas turbine blade.
Figure 2B:
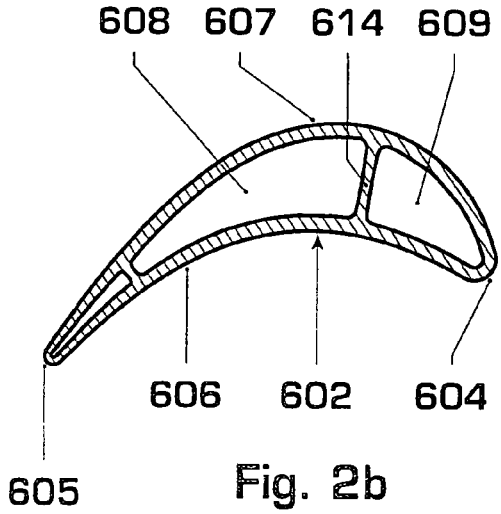

In modern gas turbo groups with high hot gas temperatures, the turbine blades of at least the first turbine stages are designed in a way in which they are cooled. An example of such a cooled turbine blade 6 is shown in FIG. 2. FIG. 2*a* in this case shows a side view of an exemplary turbine blade in a sectional view which shows the internal cooling configuration of the blade. The blade 6 comprises a blade root 601, a blade airfoil 602, and also a blade tip 603. A cross section of the blade airfoil, which shows the profile of the blade airfoil, is shown in FIG. 2*b*. The profile of the blade airfoil has a leading edge 604, a trailing edge 605, a pressure side 606 and also a suction side 607. A cooling air passage 609 extends inside the blade airfoil along the leading edge 604 of the blade airfoil. As is to be seen in the view of FIG. 2*b*, this passage is defined on one side by the wall of the blade airfoil in the region of the leading edge 604, in the region of the pressure side 606, in the region of the suction side 607, and also by a partition 614 which extends from the suction-side wall of the blade airfoil to the pressure-side wall of the blade airfoil. The cooling air passage 609 has an inlet opening 610 for cooling air in the root-side region of the blade airfoil, and has an outlet opening 611 for cooling air in the region of the blade tip. A further cooling air passage 608, which extends in serpentine form, is arranged inside the blade airfoil, wherein the cooling air which flows through said further cooling air passage is blown out in the region of the trailing edge of the blade airfoil. The blade airfoil, in the region of the trailing edge, is cooled by the cooling air which is blown out; in the further regions of the blade airfoil, the blade airfoil is purely convectively cooled. For improving the convective cooling action, fins 613 are arranged inside the cooling air passages and intensify the heat transfer there from the wall of the blade airfoil to the cooling air. The cooling air of the leading edge cooling air passage 609 is fed to the inlet opening 610, and is blown out again in the blade tip region at the outlet opening 611, and serves there for cooling the blade tip and the seals, which are not shown. A rib 612, which avoids the cooling air being prematurely mixed with hot gas, is arranged in the region of the blade tip.

Figure 3A:
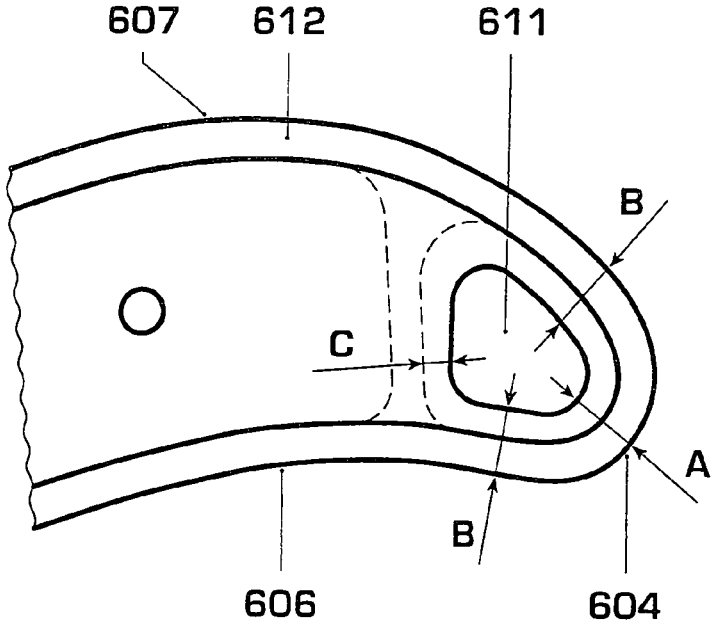
FIG. 3 shows an outlet section of a cooling air passage of a gas turbine blade.
Figure 3B:
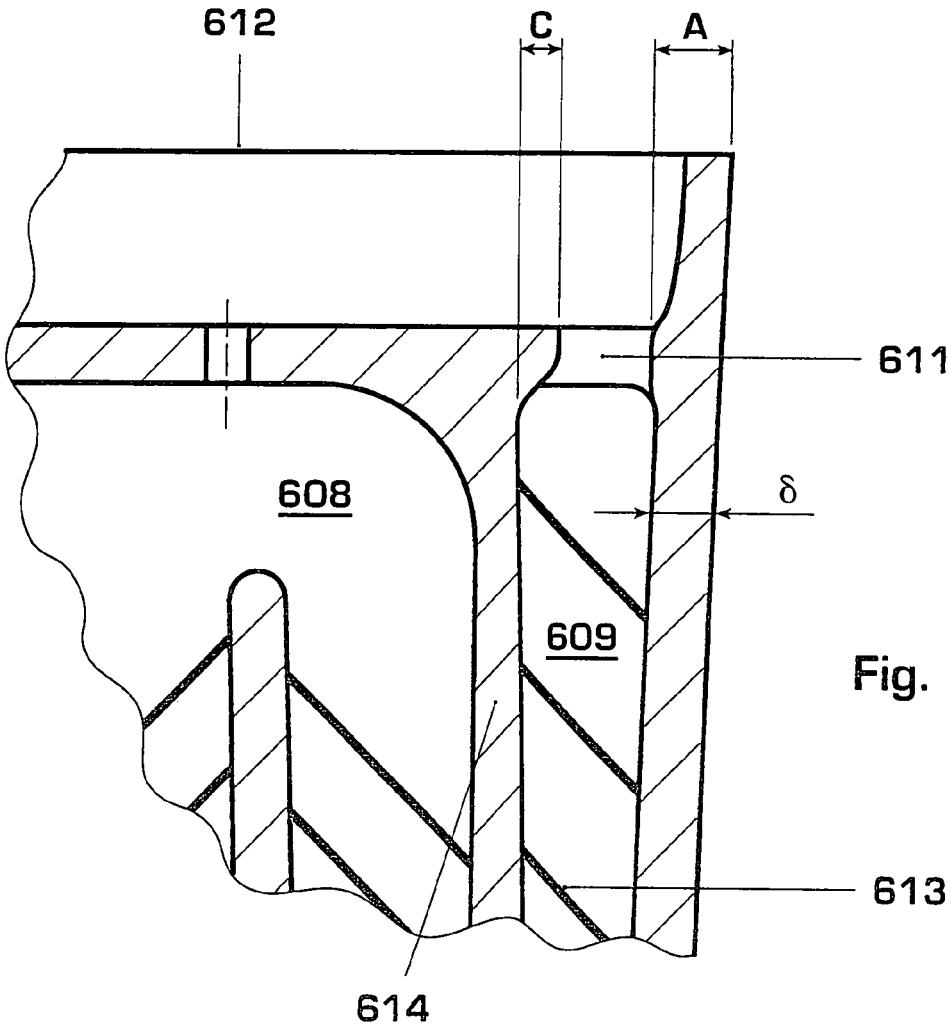

The region of the outlet opening 611 is shown enlarged in FIGS. 3*a* and 3*b*. In the plan view of FIG. 3*a*, it is to be seen that the contour of the outlet opening 611 has an essentially similar geometric shape to the cross section of the cooling air passage 609, but, compared to said cooling air passage, is reduced in cross section. The cooling air passage which extends on the leading edge side is shown by broken lines. In the region of the leading edge 604 of the blade airfoil, the distance of the contour of the outlet opening from the outer contour of the blade airfoil is the dimension A. In the region of the pressure-side wall 606 and the suction-side wall 607 of the blade airfoil, the distance of the contour of the outlet opening from the outer contour of the blade airfoil is the dimension B. In the region of the partition 614, the distance of the contour of the outlet opening from the partition is the dimension C. The thickness of the blade airfoil outer wall is indicated by δ. In this case, A preferably is $A=\delta\cdot(1.5\pm0.12)$. B is $B=\delta\cdot(1.25\pm0.12)$. C is $0<C<\delta\cdot(2\pm0.25)$.

Although the disclosure was explained in detail above with reference to an exemplary embodiment, it is obvious to the person skilled in the art that this exemplary embodiment does not limit the disclosure. In light of the preceding description, further embodiments of the disclosure, which are contained within the scope of the patent claims, present themselves to a person skilled in the art.

LIST OF DESIGNATIONS

1 Compressor
2 Combustion chamber
3 Turbine
4 Casing
5 Shaft
6 Turbine blade
61, 62, 63, 64 Stationary blades, stator blades
65, 66, 67, 68 Rotating blades, rotor blades
601 Blade root
602 Blade airfoil
603 Blade tip
604 Leading edge of blade airfoil
605 Trailing edge of blade airfoil
606 Pressure-side wall of blade airfoil
607 Suction-side wall of blade airfoil
608 Cooling air passage
609 Cooling air passage on leading edge side
610 Cooling air inlet
611 Outlet opening
612 Rib
613 Cooling air fins
614 Partition

What is claimed is:

1. A gas turbine blade, with a blade airfoil, which extends from a blade root to a blade tip, wherein the blade airfoil comprises a blade airfoil leading edge and a cooling air passage which extends along the leading edge of the blade airfoil inside the blade airfoil, which cooling air passage is defined by the wall of the blade airfoil on the leading edge, and also on the suction side and the pressure side of the blade airfoil, and which, furthermore, is defined by a partition which extends inside the blade airfoil from the pressure-side wall to the suction-side wall, and which cooling air passage steps down to an outlet opening which is arranged in the region of the blade tip, wherein the contour of the opening is geometrically similar to the cross section of the cooling air passage, and wherein the cross-sectional area of the outlet opening is smaller than the cross-sectional area of the cooling air passage.

2. The gas turbine blade as claimed in claim 1, wherein the distance (A) of the contour of the outlet opening from the outer contour of the blade airfoil in the region of the leading edge is within the range of 138% to 162% of the local wall thickness (δ) of the wall of the blade airfoil.

3. The gas turbine blade as claimed in claim 2, wherein the distance (B) of the contour of the outlet opening from the outer contour of the blade airfoil in the region of the pressure-side wall and/or the suction-side wall is within the range of 113% to 138% of the local wall thickness (δ) of the wall of the blade airfoil.

4. The gas turbine blade as claimed in claim 1, wherein the distance (B) of the contour of the outlet opening from the outer contour of the blade airfoil in the region of the pressure-side wall and/or the suction-side wall is within the range of 113% to 138% of the local wall thickness (δ) of the wall of the blade airfoil.

5. The gas turbine blade as claimed in claim 4, wherein in the region of the partition, the distance (C) of the contour of the outlet opening from the partition is within the range of 0% to 225% of the wall thickness (δ) of the wall of the blade airfoil.

6. The gas turbine blade as claimed in claim 1, wherein in the region of the partition, the distance (C) of the contour of the outlet opening from the partition is within the range of 0% to 225% of the wall thickness (δ) of the wall of the blade airfoil.

7. The gas turbine blade as claimed in claim 6, wherein the wall thickness of the wall of the blade airfoil is constant in the region of the outlet opening.

8. The gas turbine blade as claimed in claim 1, wherein the wall thickness of the wall of the blade airfoil is constant in the region of the outlet opening.

9. The gas turbine blade as claimed in claim 8, wherein the cooling air passage has an inlet opening which is arranged in the region of the blade root.

10. The gas turbine blade as claimed in claim 1, wherein the cooling air passage has an inlet opening which is arranged in the region of the blade root.

11. The gas turbine blade as claimed in claim 10, wherein the blade is designed in a way in which it is purely convectively cooled in the region of the cooling passage.

12. The gas turbine blade as claimed in claim 1, wherein the blade is designed in a way in which it is purely convectively cooled in the region of the cooling passage.

13. A gas turbine assembly, especially rotor or stator of a gas turbine, comprising at least one gas turbine blade as claimed in claim 12.

14. A gas turbine, comprising at least one gas turbine blade as claimed in claim 12.

15. A gas turbine assembly, especially rotor or stator of a gas turbine, comprising at least one gas turbine blade as claimed in claim 1.

16. A gas turbine, comprising at least one gas turbine blade as claimed in claim 1.

* * * * *